United States Patent [19]

Clifford

[11] Patent Number: 4,550,579

[45] Date of Patent: Nov. 5, 1985

[54] APPARATUS FOR THE DYEING OF SHAPED ARTICLES

[76] Inventor: G. Frank Clifford, P.O. Box 163, Old Hwy. 27, Stanley, N.C. 28164

[21] Appl. No.: 600,284

[22] Filed: Apr. 13, 1984

[51] Int. Cl.[4] ..... D06B 1/04; D06B 23/04

[52] U.S. Cl. ..... 68/5 C; 68/9; 68/205 R

[58] Field of Search ..... 68/5 C, 6, 9, 205 R; 118/64; 223/76; 8/149.1, 149.2

[56] References Cited

U.S. PATENT DOCUMENTS

| | | | |
|---|---|---|---|
| Re. 27,773 | 10/1973 | Hermes | 28/72.1 |
| 2,461,612 | 2/1949 | Olpin . | |
| 2,532,471 | 12/1950 | Wedler | 68/5 D |
| 2,848,146 | 8/1958 | Kronsbein . | |
| 2,882,119 | 4/1959 | Laucius . | |
| 2,938,811 | 5/1960 | Hermes . | |
| 3,023,598 | 3/1962 | Bellmann et al. | 68/205 R |
| 3,102,278 | 9/1963 | Reichle et al. | 8/151.2 |
| 3,131,840 | 5/1964 | Berger et al. | 223/76 |
| 3,181,750 | 5/1965 | Helliwell et al. | 223/76 |
| 3,271,102 | 9/1966 | Morgan | 8/151 |
| 3,467,484 | 9/1969 | Hermes . | |
| 3,530,214 | 9/1970 | Hermes . | |
| 3,557,395 | 1/1971 | Kronsbein | 8/149.2 |
| 3,558,260 | 1/1971 | Hermes . | |
| 3,698,855 | 10/1972 | Sutton | 8/150 |
| 3,738,019 | 6/1973 | Forg et al. | 8/149.2 X |
| 3,770,528 | 11/1973 | Hermes | 156/2 |
| 3,771,949 | 11/1973 | Hermes . | |
| 3,837,796 | 9/1974 | Fleissner et al. | 8/149.2 X |
| 3,868,835 | 3/1975 | Todd-Reave | 68/205 R X |
| 3,921,420 | 11/1975 | Aurich et al. | 68/5 C |
| 3,943,105 | 3/1976 | Hermes | 260/47 C |
| 3,950,967 | 4/1976 | Davies et al. | 68/5 D |
| 3,967,923 | 7/1976 | Ameling | 8/149.1 |
| 3,973,902 | 8/1976 | Zimmermann et al. . | |
| 4,047,889 | 9/1977 | Hermes . | |
| 4,055,971 | 11/1977 | Hermes | 68/9 |
| 4,115,054 | 9/1978 | Hermes . | |
| 4,196,231 | 4/1980 | Hubers | 427/240 |
| 4,245,991 | 1/1981 | Haddad et al. | 8/506 |
| 4,293,305 | 10/1981 | Wilson | 8/115.6 |
| 4,331,443 | 5/1982 | Kostka et al. | 8/671 |
| 4,361,019 | 11/1982 | Maund | 68/62 |
| 4,371,371 | 2/1983 | Smrekar | 8/531 |
| 4,377,389 | 3/1983 | Haddad et al. | 8/506 |
| 4,392,366 | 7/1983 | Godfrey | 68/205 R |
| 4,394,126 | 7/1983 | Wilson | 8/115.6 |
| 4,426,297 | 1/1984 | Wilson | 8/115.6 X |

FOREIGN PATENT DOCUMENTS

| | | |
|---|---|---|
| 0099111 | 7/1983 | European Pat. Off. . |
| 955260 | 6/1949 | France . |

*Primary Examiner*—Philip R. Coe

*Attorney, Agent, or Firm*—Finnegan, Henderson, Farabow, Garrett & Dunner

[57] ABSTRACT

The present invention provides an apparatus for the dyeing of shaped articles. The apparatus transports the shaped article in a treating chamber within the apparatus during the dyeing process; surrounds the shaped article with a non-reactive environment in the treatment chamber; preheats the shaped article; flows a thin continuous film of a dye composition over the surfaces of the shaped article in a non-reactive environment at an elevated temperature; and cools the dyed shaped article. The apparatus can also rinse and dry the dye shaped article. The apparatus further includes an applicator head for applying the thin continuous film of the dye composition over the shaped article and a carrier for positioning the shaped article in vertical alignment with the applicator head.

28 Claims, 17 Drawing Figures

APPARATUS FOR THE DYEING OF SHAPED ARTICLES

FIELD OF THE INVENTION

The present invention relates to the dyeing of shaped articles and, more particularly, it relates to an apparatus for significantly reducing degradation of the dyestuff used in the nonaqueous high temperature dyeing of shaped articles

BACKGROUND OF THE INVENTION

The dyeing of shaped articles, especially garments of a synthetic material such as polyester, is carried out with a dyestuff dispersed in an aqueous bath. The textile material is placed in the bath for a long enough time period to allow sufficient dyestuff to be absorbed to provide the desired coloration.

Such a dyeing process poses several disadvantages and limitations. Since the temperature of the aqueous bath cannot exceed the boiling temperature of the water, the process cannot be conducted at elevated temperatures, unless high pressure is used. Even then temperatures of only 250° F. to 270° F. are reached. Consequently, relatively long dyeing cycles are needed.

Additionally, the aqueous bath is generally disposed of after each dyeing cycle because most of the dyestuff has been absorbed by the textile material. The disposal of the used dye bath presents obvious environmental problems, as well as economic losses due to discharge of the residual dyestuff and chemicals remaining in the bath.

Dyeing at elevated temperatures with a non-aqueous system overcomes many of these problems and provides several advantages. Elevated temperatures reduce the time needed to dye the textile material. Shorter dyeing cycles make the process more economical and efficient.

Various dye processes that use non-aqueous dye compositions have been proposed for the treatment of textile materials. One technique involves immersing the textile material in a bath comprising an organic dyestuff dissolved in a high boiling aromatic ester or a cycloaliphatic diester. Such dyeing processes have several inherent disadvantages that prevent their effective and efficient use. The dye composition does not remain stable over a period of time when used in an ambient atmosphere; significant degradation of the dye composition often occurs after only a few hours of use.

Whether the dye composition is aqueous or non-aqueous, it is usually brought into contact with the textile material by spraying or showering, or by immersion. Spraying or showering is basically a pressurized operation in which the dye composition is applied to the textile material in the form of droplets. Examples of spraying or showering processes are provided in U.S. Pat. No. 3,868,835 to Todd-Reeve, U.S. Pat. No. 3,557,395 to Kronsbein, U.S. Pat. No. 3,181,750 to Helliwell et al., and U.S. Pat. No. 3,131,840 to Berger et al.

Spraying or showering techniques have several limitations and disadvantages. Since the dye composition cools as it is sprayed or showered through the air, the dye composition cannot be maintained at a constant temperature. Such temperature fluctuations result in poor dye uniformity, especially at elevated temperatures, such as 350° F. to 380° F.

Since it is difficult to maintain the dye composition at an elevated temperature during the spraying or showering, longer periods of time are needed for complete dyeing to occur. If the dye cycle is shortened, uniform dyeing will not be achieved and a relatively poor quality product results. Also, spraying or showering exposes the largest surface area of the dye composition to the atmosphere.

Immersion techniques are disadvantageous, since large volumes of the dye composition are needed. Even though immersion provides better heat transfer than spraying or showering, such processes are inefficient and uneconomical.

In short, present apparatus and processes are incapable of dyeing uniformly a shaped article with a non-aqueous dye composition in a sufficiently short time period at an elevated temperature and with a minimal amount of dye composition. This is particularly true with respect to some synthetic materials, such as polyester, that are difficult to dye.

SUMMARY OF THE INVENTION

It is therefore an object of the present invention to provide an improved apparatus for the dyeing of shaped articles at an elevated temperature in which the dyestuff does not undergo significant degradation.

It is an object of the present invention to provide an apparatus for the non-aqueous dyeing of shaped articles at an elevated temperature that allows for the recycling of the dye composition without significant degradation of the dyestuff.

It is also an object to provide an apparatus for the nonaqueous dyeing of shaped articles at an elevated temperature in which the various steps, such as preheating, dyeing, cooling, rinsing, and drying, are conducted in the same non-reactive environment.

It is also an object to provide an apparatus for the non-aqueous dyeing of shaped articles at an elevated temperature that uses a minimum amount of dye composition, but provides excellent heat transfer properties.

It is a further object of this invention to provide an apparatus for the rapid dyeing of shaped articles composed of difficult to dye synthetic materials, such as polyester.

Additional objects and advantages of the invention will be set forth in part in the description that follows and in part will be obvious from the description, or may be learned by practice of the invention. The objects and advantages of the invention may be realized and obtained by means of instrumentalities and combinations particularly pointed out in the appended claims.

To achieve these and other objectives, the present invention provides an apparatus for the dyeing of shaped articles comprising means for surrounding a shaped article with a non-reactive environment in a treatment chamber and means for flowing a thin continuous film of a dye composition flow over the surfaces of a shaped article at an elevated temperature in a non-reactive environment.

As used herein, the term shaped article includes any article having a definite form. Examples of shaped articles include garments, as well as components of the garment and cut-up pieces that can be assembled or sewn into a garment, home furnishings, hats, seat covers, furniture coverings, and any other articles capable of being dyed by flow of a dye composition thereover. The article can be made of either a textile material or a nontextile material. As used herein, the term surrounding the shaped article includes surrounding with a nonreactive environment any dye composition that is in contact with the shaped article.

In another embodiment, the present invention provides an apparatus that comprises means for transporting a shaped article in a treatment chamber within the apparatus; means for surrounding the shaped article with a non-reactive environment in the treatment chamber; means for flowing a thin continuous film of the dye composition over the surfaces of the shaped article at an elevated temperature in the non-reactive environment; means for preheating the shaped article prior to flowing the thin continuous film over the shaped article; and means for cooling the dyed shaped article. The apparatus can also include means for rinsing the dyed shaped article and means for drying the dyed and rinsed shaped article.

The present invention further provides an applicator head for flowing a thin continuous film of a dye composition over the surfaces of a shaped article comprising an upper horizontally extending retaining wall having a circumferential rim depending from the outer periphery of the upper wall and a lower horizontal wall connected in spaced relation to the upper wall. The periphery of the lower wall is spaced inwardly from the circumferential rim to define a downwardly facing discharge opening. The upper wall and lower wall together form a dispersion plenum.

Preferably, the dye composition is a substantially non-aqueous system comprising a solvent, having a boiling point greater than water, and a dyestuff. In a preferred embodiment, the solvent is at least one of an aromatic ester and a cycloaliphatic diester. The term dyestuff collectively refers to all of the individual dyestuffs that are present in the dye composition to obtain the desired coloration of the textile material.

The non-reactive environment is preferably selected from the group consisting of fluorocarbons and halogenated hydrocarbons. The preferred fluorocarbon is 1,1,2-trichloro-1,1,2-trifluoroethane, which has the chemical formula $CCl_2FCClF_2$. The preferred halogenated hydrocarbon is 1,1,1-trichloroethane (methyl chloroform), which has the chemical formula $CH_3CCl_3$.

The apparatus of the present invention obviates the problem of dye composition degradation by providing and maintaining a non-reactive environment, such as a fluorocarbon or a halogenated hydrocarbon, throughout the whole dyeing cycle and, in particular, during the time the shaped article is being contacted with the dye composition. This non-reactive environment prevents the dye composition from undergoing degradation. As used herein the term degradation refers to the loss of coloration or color strength of the dyestuff in the dye composition.

The apparatus further allows the non-aqueous dyeing of shaped articles to be conducted at an elevated temperature, since the solvent preferably has a boiling point greater than water. As a result of the elevated dyeing temperature, the dyeing process can be performed in less time than with aqueous dyeing processes.

Because degradation of the dyestuff has been significantly reduced, the apparatus permits the recycling of the dye composition without adversely affecting the quality of the dyed products. Moreover, environmental benefits are provided, because the used composition is not discharged into the environment.

The apparatus significantly eliminates problems of poor quality dyeing, color distortion, or shade variation that are caused by fluctuations in dye temperature, which typically result when the dye is sprayed or showered onto the shaped article.

The apparatus is especially useful in dyeing shaped articles such as shirts, skirts, pants, hats, home furnishings, and or seat covers. It also allows, in the case of synthetic materials such as polyester, for the simultaneous shaping and setting of the textile material, while the material is being dyed. The shaping and setting of the material provides a crease, if desired, and smooths out any wrinkles.

The foregoing and other objects, features, and advantages of the present invention will be made more apparent from the following description of the preferred embodiment.

BRIEF DESCRIPTION OF THE DRAWINGS

The accompanying drawings, which are incorporated in and constitute a part of the specification, illustrate one embodiment of the invention and, together with the description, serve to explain the principles of the invention.

DESCRIPTION OF THE PREFERRED EMBODIMENT

Reference is now made in detail to the present preferred embodiment, as illustrated in FIGS. 1–17. In accordance with the invention, an apparatus 10, for the dyeing of shaped articles 12 comprises means for surrounding a shaped article 12 with a non-reactive environment in a treatment chamber 14 and means for flowing a thin continuous film of a dye composition over the surfaces of a shaped article at an elevated temperature in a non-reactive environment.

Figure 2:
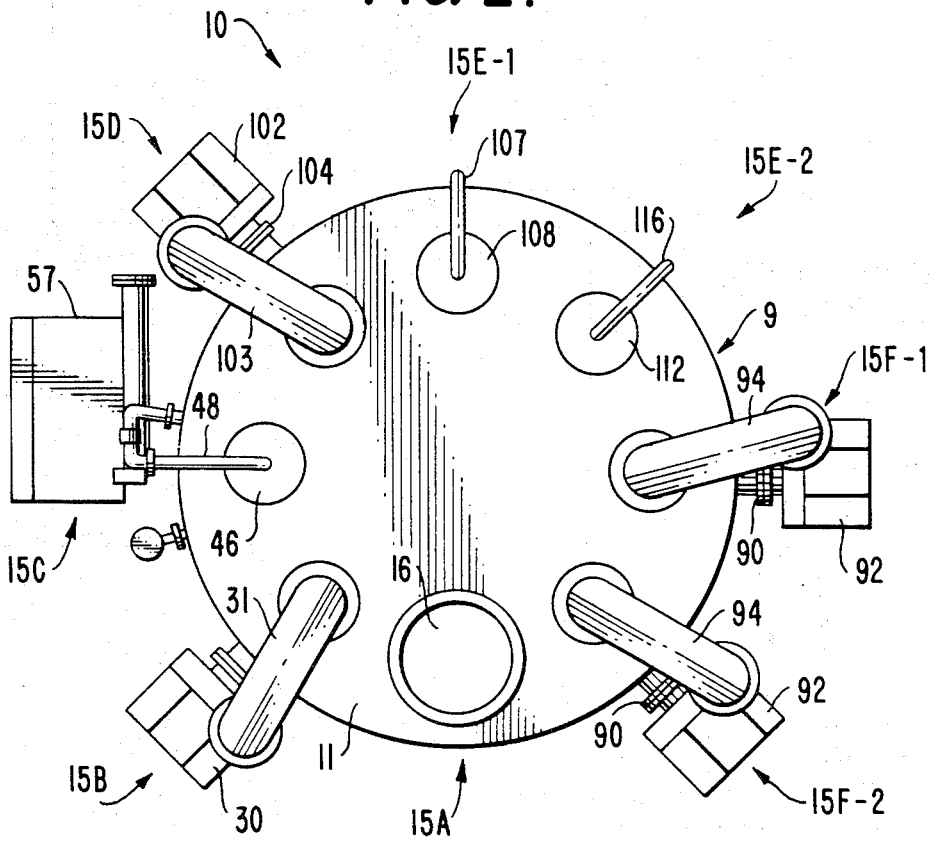
FIG. 2 is a plan view of the apparatus of FIG. 1.
Figure 3:
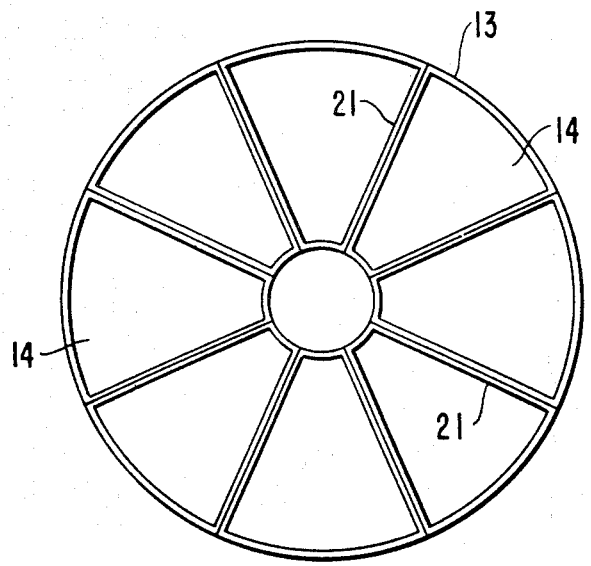
FIG. 3 is a plan view of the interior of the apparatus of FIG. 1 showing a plurality of treatment chambers.

The apparatus 10 also can comprise means for transporting the shaped article within the apparatus in a treatment chamber 14; means for preheating the shaped article prior to flowing the thin continuous film over the shaped article; and means for cooling the dyed shaped article. The apparatus can further include rinse means for rinsing the dyed shaped article and drying means for drying the dyed shaped article As shown in FIGS. 1 to 3, the apparatus includes a stationary cylindrical vessel 9 with a vertical axis around which is rotated a carousel unit 13, having a plurality of treatment chambers 14 for supporting and transporting simultaneously several shaped articles 12 from work station 15 to work station 15.

More particularly, the carousel unit 13 has a plurality of treatment chambers 14, each of which contains a shaped article 12 that is to be treated in the apparatus 10. The shaped article 12, contained in each treatment chamber 14, is moved from one work station to another as the carousel unit 13 rotates. A different treatment, such as loading, preheating, dyeing, cooling, rinsing, drying, and unloading is performed on the shaped article 12 at each station 15. The details of the structure of the apparatus 10 will be described hereinafter.

Figure 1:
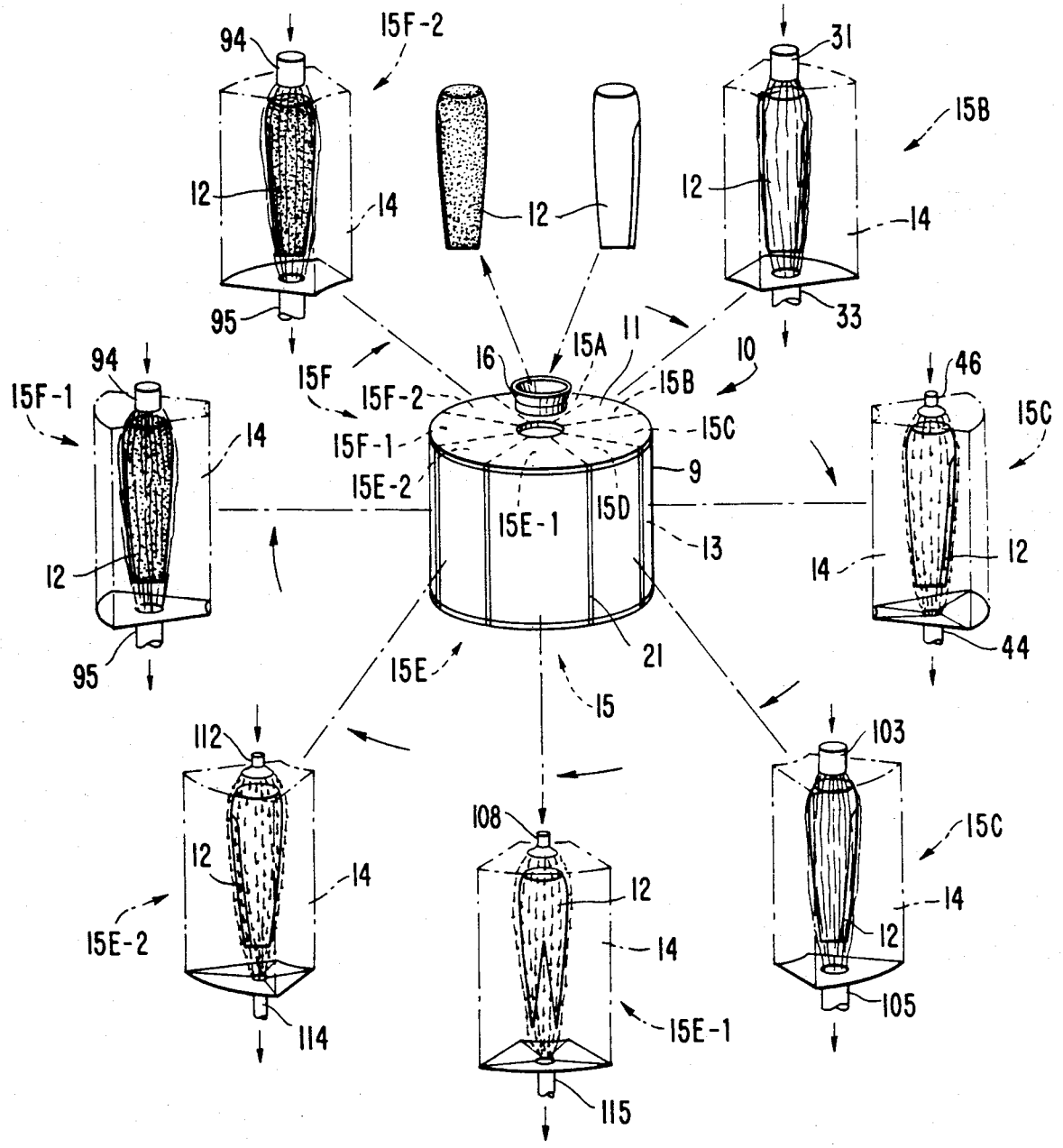
FIG. 1 is a schematic diagram depicting the apparatus of the present invention.

As shown in FIG. 1, the work stations 15 include a loading and unloading station 15A, a preheating station 15B, a dyeing station 15C, a cooling station 15D, a rinsing station 15E, and a drying station 15F. In the loading and unloading station 15A, the shaped article 12 mounted on a carrier 70 (FIG. 4) is either loaded or unloaded from the treatment chamber 14, depending upon whether the treatment process is beginning or ending.

The chamber 14 has a port 16, through which the shaped article 12 is loaded and unloaded. Preferably, the port 16 is in the top cover plate 11 of the apparatus 10, but it may be located elsewhere in the apparatus depending upon the compound used for the non-reactive environment. With some compounds, the port 16 may be sealed to render the apparatus 10 airtight. Preferably, if the compound used as the non-reactive environment is heavier than air, the port 16 can be open and located in the top cover plate 11, since the non-reactive compound displaces the ambient air from the apparatus 10.

Figure 5:
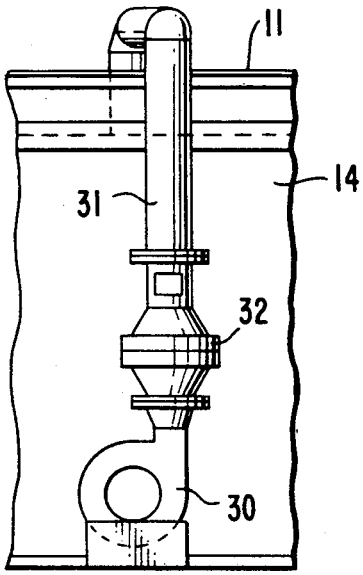
FIG. 5 is a front view of the preheating and drying work stations of FIG. 1.
Figure 6:
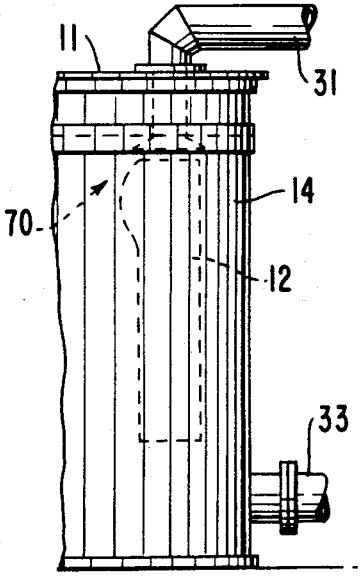
FIG. 6 is a side view of the preheating and drying work stations shown in FIG. 5.

Once the first shaped article 12 to be processed is positioned on the carrier 70 and then loaded into one of the chambers 14, the carousel unit 13 is rotated so that the newly loaded chamber 14 is in the preheating station 15B. (FIGS. 5 and 6). In the preheating station 15B, the shaped article is heated to a temperature approximately equal to that of the dye composition to be applied in the dyeing station 15C. As the carousel unit 13 rotates, the next empty chambers 14 is then positioned in the loading and unloading station 15A so that another shaped article can be loaded into the empty chamber 14.

Figure 7:
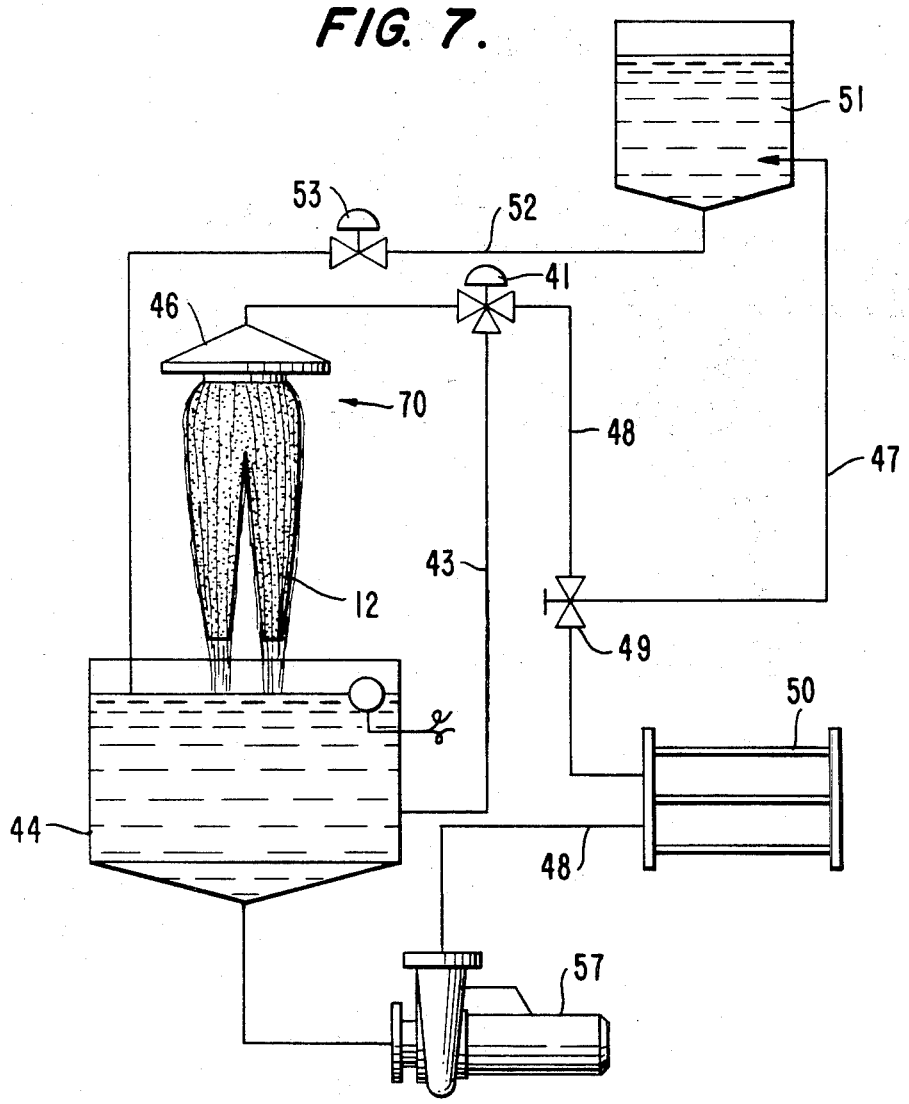
FIG. 7 is a more detailed schematic diagram of the dyeing work station of FIG. 1.
Figure 8:
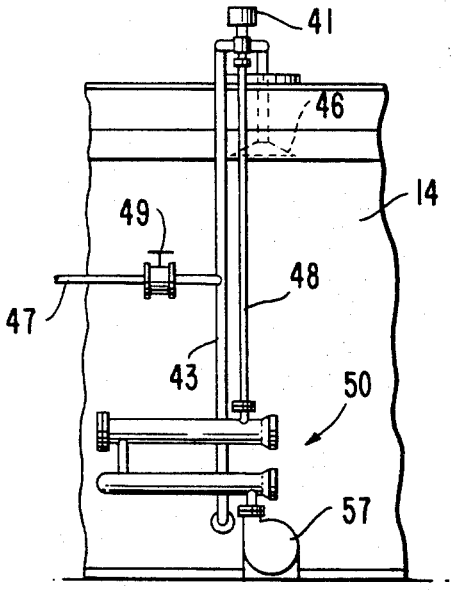
FIG. 8 is a front view of the dyeing work station of FIG. 1.
Figure 9:
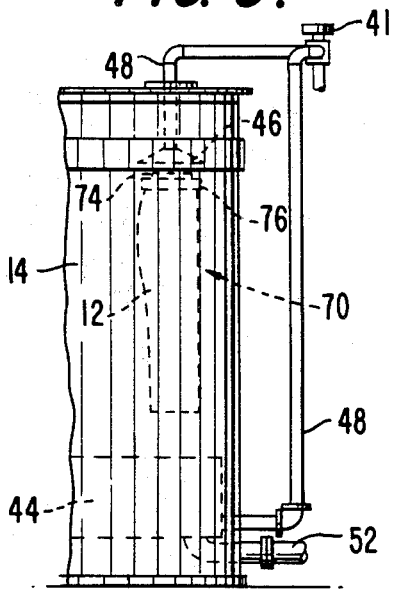
FIG. 9 is a side view of the dyeing work station shown in FIG. 8.

After a predetermined time period, the carousel unit 13 is rotated and the preheated shaped article 12 is positioned in the dyeing station 15C. (FIGS. 7–9). In the dyeing station 15C, the dye composition is applied to the shaped article 12. The predetermined time period depends upon the time necessary to effectuate the desired dyeing of the shaped article 12 in the dyeing station 15C. During the time needed to dye the shaped article 12, unloading and loading of the chamber 14, under the loading and unloading station 15A, takes place. The predetermined time period for rotating the carousel unit 13 is governed by the dyeing time: therefore, the shaped article 12 in each chamber 14 remains at each work station 15 the same amount of time as determined by the dyeing cycle.

After the shaped article 12 in the dyeing work station 15C is dyed to the desired coloration, the carousel unit 13 is again rotated so that the dyed shaped article is positioned in the cooling station 15D. The shaped article 12 is then cooled to a temperature sufficient to fix the dyestuff in the shaped article and to prevent the shaped article from changing its shape.

Figure 12:
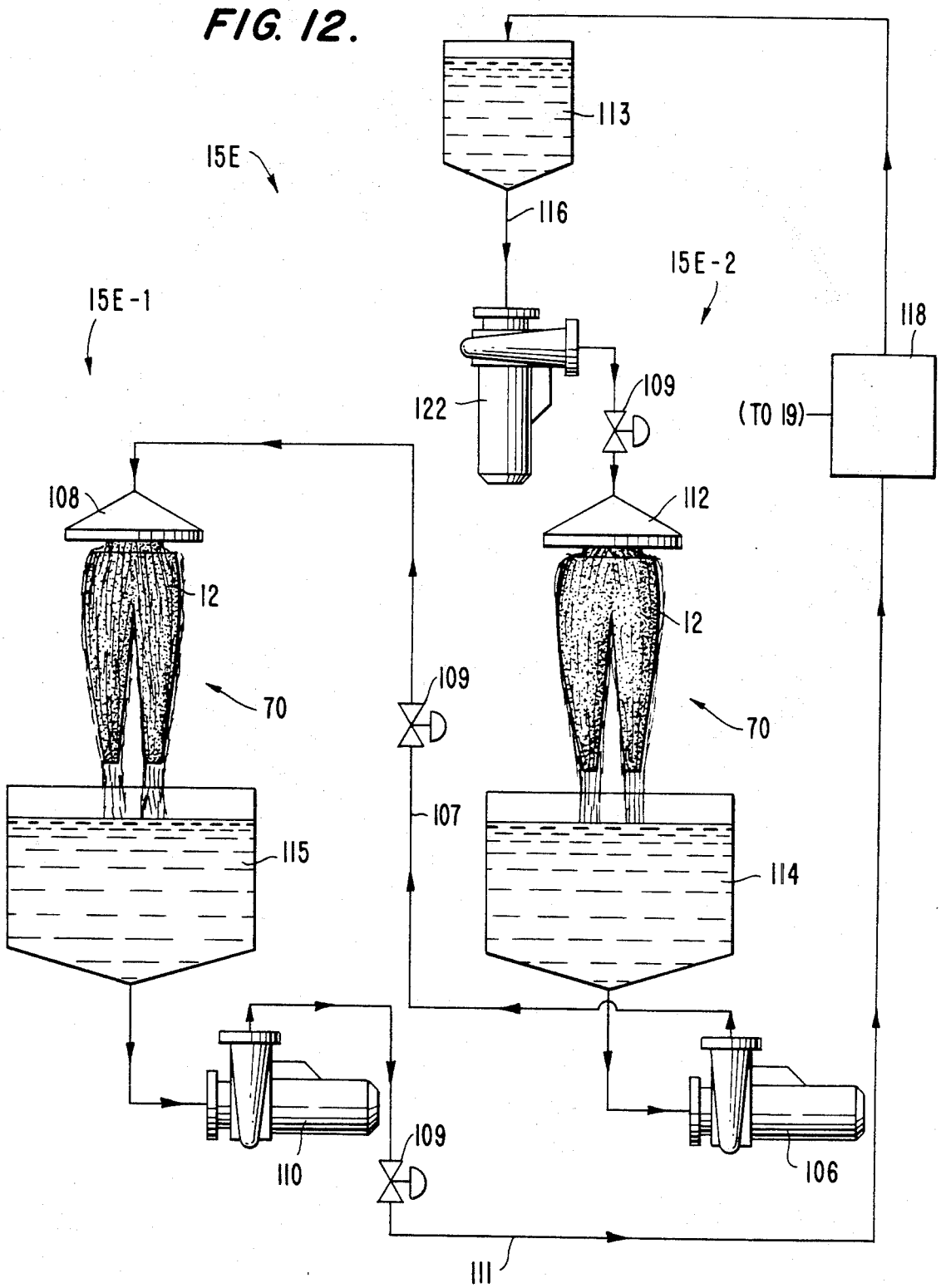
FIG. 12 is a more detailed schematic diagram of the rinsing work station of FIG. 1.

After sufficient cooling, the carousel unit 13 is then rotated to place the cooled shaped article 12 in rinsing stations 15E. (FIG. 12). The used, but non-absorbed, excess dye composition is rinsed from the shaped article and recycled for use in the dyeing station 15C.

Once the shaped article 12 is rinsed, the carousel 13 is rotated so that the dyed shaped article is positioned in the drying station 15F. The shaped article is heated to vaporize any excess liquid. After drying, the shaped article 12 on the carrier 70 is unloaded from the chamber 14 through port 16 in the unloading station 15A.

As shown in FIG. 3, the plurality of treatment chambers 14 that form the carousel unit 13 are separated from each other by walls 21. The walls 21 can be constructed to seal each chamber 14 from the adjacent chamber to prevent the non-reactive environment in one chamber 14 from leaking into the other chambers 14. Preferably, the same non-reactive compound and environment is used in all of the chambers 14 so that such a tight seal between chambers 14 need not be maintained by the walls 21.

The carousel unit 13 allows all of the stations 15 to treat simultaneously a number of shaped articles 12 that are positioned on a plurality of carriers 70 within a plurality of chambers 14. Consequently, one shaped article is being dyed, while others are simultaneously being unloaded, loaded, preheated, cooled, rinsed, and dried. Usually, the number of chambers 14 forming the carousel unit 13 corresponds to the number of work stations 15 so that a chamber 14 is positioned at each work station 15 every time the carousel unit 13 rotates.

Figure 17:
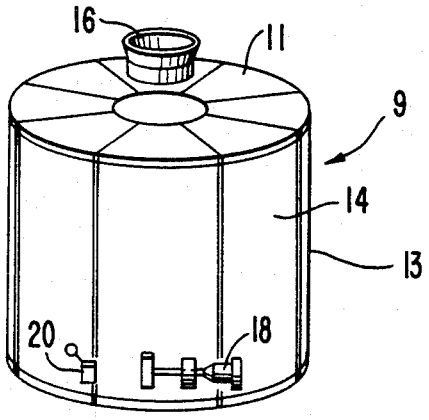
FIG. 17 is a schematic diagram of the means used to rotate the carousel unit of FIG. 1.

As embodied herein, as shown in FIG. 17, the means for transporting the shaped article 12 within the apparatus 10 in the chamber 14 between the various stations 15 includes the carousel unit 13 with the carriers 70 and a means for rotating the carousel unit 13. As embodied herein, the rotating means includes a motor and gear reducer 18 for rotating the carousel unit 13. A carousel position switch 20 determines the movement of the carousel unit 13. However, other known means for rotating the carousel unit 13 around the stations 15 can also be used.

As the chamber 14 rotates among the various work stations, a non-reactive environment is maintained around the shaped article 12 in the chamber 14. This prevents the degradation of the dyestuff and as a result the dye composition can be recycled and reused repeatedly for multiple dyeings. Preferably, the same non-reactive environment is present in the chamber 14 at all of the stations 15A to 15F to preserve the integrity of the non-reactive environment within the stationary cylindrical vessel 9.

Figure 4:
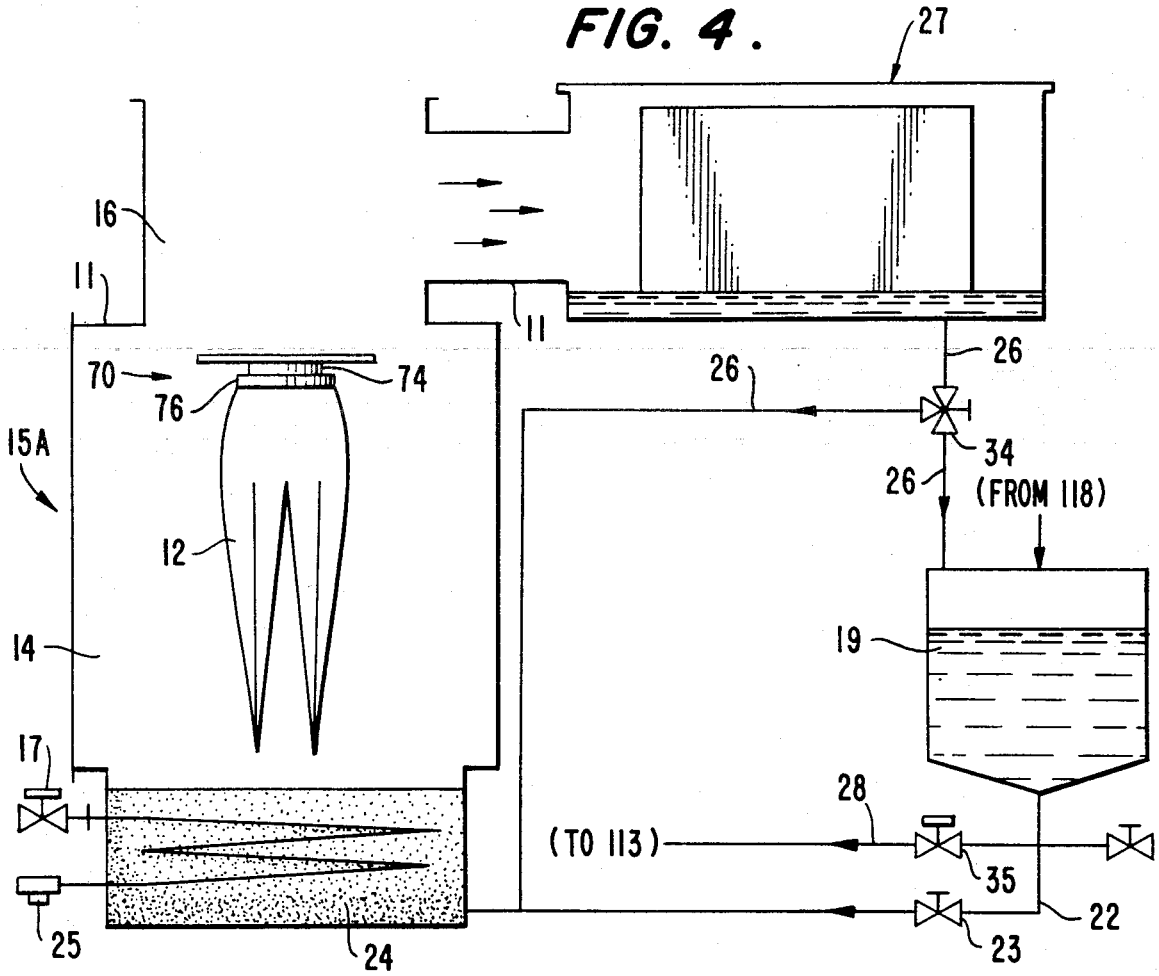
FIG. 4 is a more detailed schematic diagram of the loading and unloading work station of FIG. 1.

As embodied herein, the means for surrounding the shaped article 12 with a non-reactive environment in the treatment chamber 14 includes a gas vapor generator 24 for producing the non-reactive environment. Preferably, as shown in FIG. 4, the vapor generator 24 is stationary and located in the loading station 15A below the chamber 14.

As used herein, the term non-reactive environment is defined as any composition that can be maintained as a stable gas at the dyeing temperature, without reacting with the dye composition or the textile material, and that will displace the air and, therefore, the oxygen surrounding the shaped article. Preferably, the non-reactive environment should have a boiling point below the temperature of the dyeing step, but above the temperature of the rinse step. This permits use of the compound forming the environment as a gas in the dyeing station 15C and a liquid in the rinse station 15E. Compounds that can be used as a non-reactive environment include fluorocarbons; halogenated hydrocarbons; inert gases such argon, neon, and helium; low boiling alcohols and organic solvents; nitrogen; carbon dioxide; and combinations thereof. Fluorocarbons or halogenated hydrocarbons are the preferred compounds. Preferably, the compound selected for the non-reactive environment is, in a gaseous state, heavier than air.

Fluorocarbon solvents are relatively easy to maintain in a vapor state; fairly safe for human exposure; and unlikely to break down into acid components. Moreover, they can be easily separated from the dye composition by distillation. This permits the recycle of both components.

An especially effective flurocarbon is 1,1,2-trichloro1,2,2-trifluoroethane, which has the chemical formula $CCl_2FCClF_2$ and is sold by E. I. DuPont de Nemours and Company under the trademark "Freon TF". Freon TF has a molecular weight of 187.379, a boiling point of 117.63° F., and a freezing point of −31° F. It is nonflammable and has a threshold limit value (T.L.V.) of 1000 ppm.

A preferred halogenated hydrocarbon is 1,1,1-trichloroethane (methyl-chloroform), which has the chemical formula $CH_3CCl_3$ and a molecular weight of 133.42, a boiling range of 162° F. to 190° F., and a freezing point of −58.0° F. It is nonflammable and has a threshold limit value (T.L.V.) of 350 ppm.

The vapor generator 24 vaporizes the compound that is to be used as the non-reactive environment. The compound is fed into the vapor generator 24 from a tank 19 through a feed line 22. A valve 23 controls the flow of the feed. A steam source 17 with a condensate trap 25 is used as a heating source for the vapor generator 24.

As the generator 24 fills the chamber 14 with the compound of the non-reactive environment, some of the non-reactive compound escapes through the port 16 and is collected by a condenser 27 positioned on the top cover plate 11 of the apparatus 10. The condenser 27 condenses the collected compound to a liquid and returns it through conduit 26 to either the tank 19 or the vapor generator 24. A valve 34 controls the flow in the conduit 26.

The condensed compound can also be supplied to the rinse station 15E for use as a rinse liquid through conduit 28 controlled by valve 35, if the rinse station 15E uses the same nonreactive compound for rinsing as in the vapor generator 24. Similarly, reclaimed rinse liquid can be recycled to the tank 19 from a distillation unit 118 that receives its feed from the rinsing station 15E, as more fully described below.

Preferably, the chambers 14 are maintained at a temperature above the condensation temperature of the compound forming the non-reactive environment. Once the non-reactive environment is established in all of the chambers 14, the carousel unit 13 is continuously rotated among the various work station 15, without the need of reestablishing a non-reactive environment in the chambers 14 each time.

In the preheating work station 15B shown in FIGS. 5 and 6, the means for preheating the shaped article 12, prior to flowing the thin continuous film of the dye composition over the shaped article 12, includes gas blower means for circulating a gas forming the non-reactive environment around the shaped article 12 and a heating unit 32 for heating the circulating gas. As embodied herein, the gas blower means includes a gas blower 30 and a conduit 31 leading the gas from the gas blower 30 into the chamber 14 through the aligned open interior of the article carrier 70. The gas exits from the chamber 14 through a return outlet 33 to the blower 30 and the heating unit 32.

The heating unit 32 preferably contains one or more heating coils, as well as various temperature controls and dampers. The heating coils can have a steam source to heat the coils. Preferably, the gas blown on the shaped article is the compound, as defined above, that provides the non-reactive environment.

Figure 11:
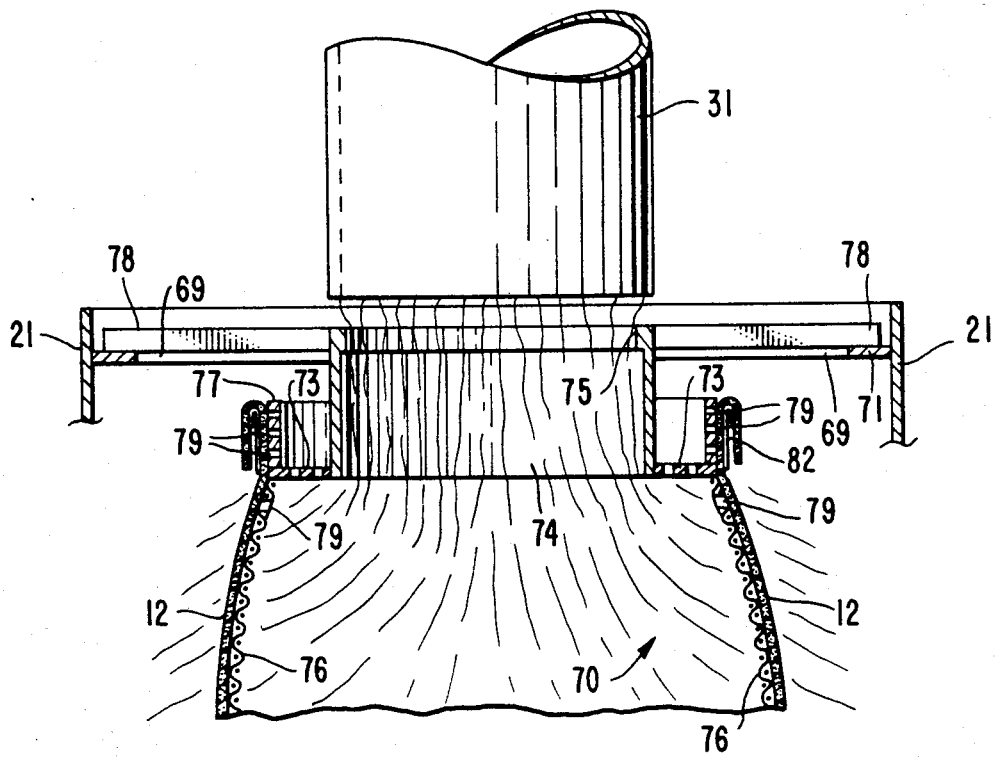
FIG. 11 is a schematic diagram showing the passage of the non-reactive environment gas through the shaped article in any one of the preheating, cooling, and drying stations.

As shown in FIG. 11, in the preheating station 15B, the conduit 31 is positioned above the shaped article 12 in the chamber 14 to allow the heated gas to flow through the shaped article 12 on the carrier 70. This positioning provides an effective and efficient heating of the shaped article 12.

After the shaped article is preheated, the chamber 14 is rotated to the dyeing work station 15C shown in FIGS. 7–9. The means for flowing a continuous thin film over the surfaces of the shaped article 12 includes an applicator head 46 for flowing a thin continuous film of the dye composition over the surfaces of the shaped article 12; means for supplying the dye composition to the applicator head 46, and a heating unit 50 for heating the dye composition prior to supplying the dye composition to the applicator head. The supply means includes a pump 57 for pumping the dye composition from a main tank 44 through a conduit 48 to the heating unit 50.

When a shaped article 12 is not in the chamber 14, a diverter valve 41 prevents the flow of the dye composition to the applicator head 46. Rather, the dye composition is returned to the main tank 44 through a bypass line 43. This allows the dye composition to be maintained at the dyeing temperature by continued circulation and heating while the carousel unit 13 rotates.

The main tank 44 is located in the dyeing station 15C below the carousel unit 13. The main tank 44 can be relatively small, such as 5 gallons, in comparison to previous apparatus, due to the efficiency of the present dyeing process. The main tank 44 is maintained in a non-reactive environment to prevent dye degradation.

A reservoir tank 51 contains a reserve supply of dye composition for use as the supply of the dye composition in the main tank 44 diminishes. The dye composition from the reservoir tank 51 is fed into the main tank 44 through a conduit 52 controlled by valve 53. A conduit 47 can also feed heated dye composition through the heating unit 50 to the reservoir tank 51 in which the dye composition is stored until it is needed. A valve 49 controls the flow between the conduit 48 and the conduit 47.

Figure 10:
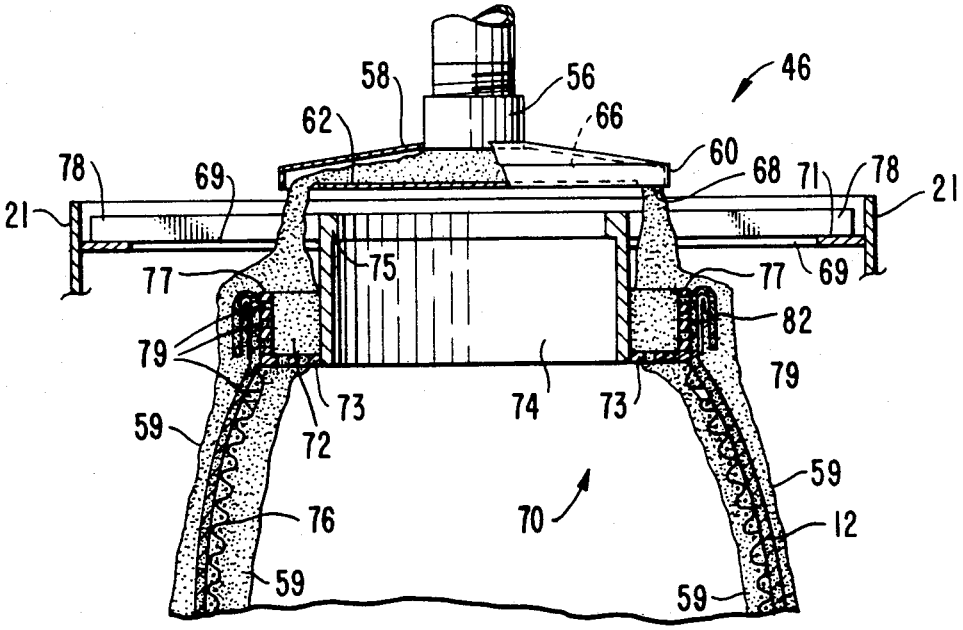
FIG. 10 is a schematic diagram showing the contacting of the shaped article with a thin continuous film of the dye composition in the dyeing station of the apparatus in FIG. 1.

As shown in FIGS. 7 and 10, the applicator head 46 is preferably positioned directly above the shaped article 12. The applicator head 46 applies the dye composition in a manner that a thin continuous film 59 of the dye composition flows over all of the surfaces of the shaped article 12, as shown in FIG. 10.

The entire shaped article 12 is in contact with the dye composition throughout the dyeing process. The shaped article 12 is accordingly exposed to an environment that is substantially the same as in an immersion dyeing process. Indeed, since the film 59 is in constant motion and is flowing very rapidly, the shaped article 12 is continuously exposed to fresh dye composition. This dynamic condition cannot be achieved in an immersion bath. For this reason, this embodiment can be characterized as a microbath technique. The non-reactive environment surrounds the microbath to prevent the degradation of the dye composition.

In the microbath technique, the dye composition is in constant contact with the entire shaped article 12 virtually through the whole dyeing process. This constant contact between the dye composition of the microbath and the shaped article 12 provides four significant advantages. First, it results in longer effective contact times between the shaped article and the composition. This results in greater absorption of the composition by the shaped article in a given period of time. Second, since the dye composition does not travel through the atmosphere surrounding the shaped article prior to contact, the temperature of the composition and of the shaped article can be easily maintained at the desired level. Third, only a relatively small amount of the dye composition is required to perform the dyeing operation. This eliminates the necessity of heating the large volumes required in immersion dyeing. Fourth, all portions of the shaped article are in contact with the dye composition for essentially the same period of time.

The microbath technique is to be distinguished from previous processes that spray or shower the dye composition onto the shaped article, or immerse the shaped article in a dye bath. Spray or shower techniques apply the dye liquid to the shaped article in the form of droplets or fine particles which expose the largest liquid surface area to the surrounding ambient atmosphere. As a result, the entire material is not in constant contact with the dye composition throughout the dyeing step. Moreover, since the droplets pass through the surrounding atmosphere before contacting the shaped article, significant heat loss occurs. This makes it difficult to maintain the dye composition and the shaped article at the appropriate temperature. Also, at elevated temperature significant dye degradation occurs because of increased mixing with the ambient air.

In an immersion technique, the entire shaped article is immersed in a large volume of the dye composition. Although the shaped article is completely covered by the dye composition as in the microbath technique, a significantly larger quantity of dye composition is required that must also be heated and stored. Furthermore, the dye composition in an immersion process is not in constant and rapid motion and hence, the textile material is not continuously exposed to fresh dye composition.

Figure 13:
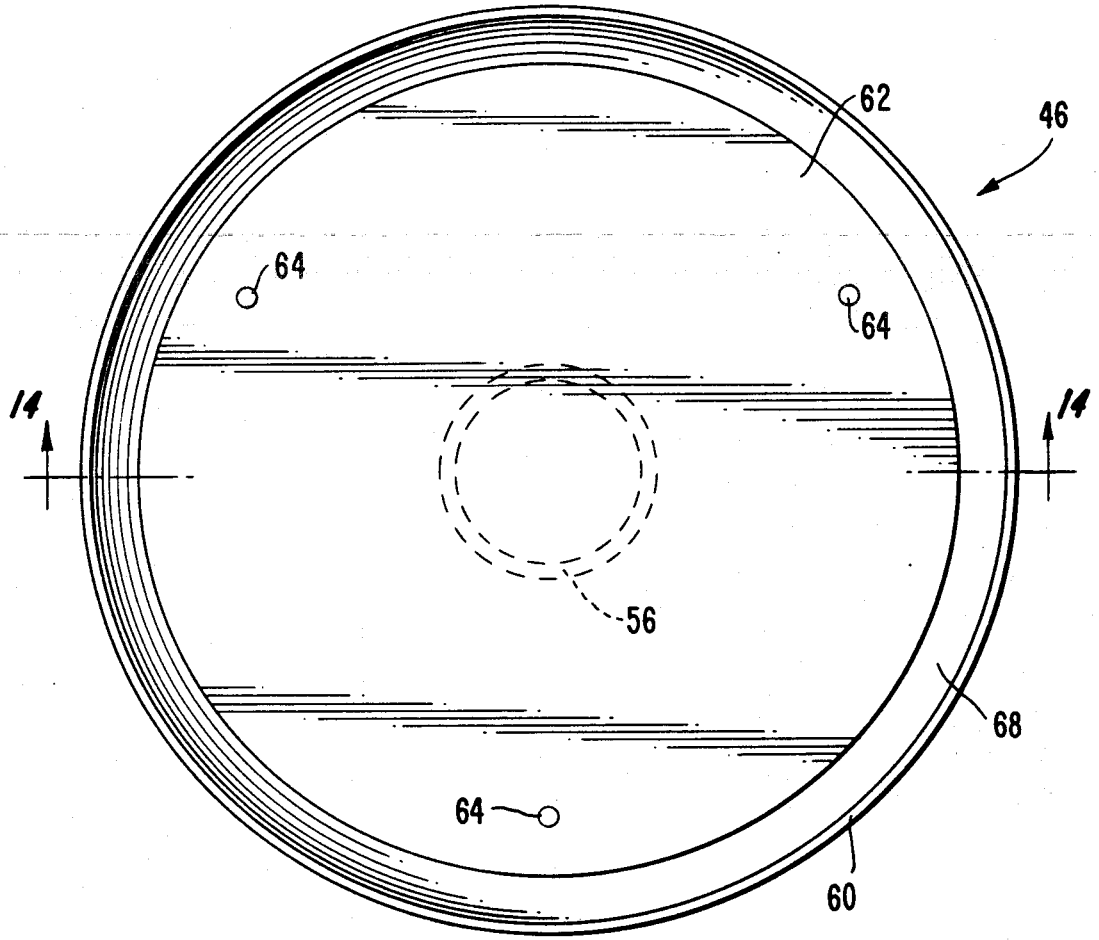
FIG. 13 is a plan view of an applicator head used in the assembly shown in FIGS. 7, 8, and 12.
Figure 14:
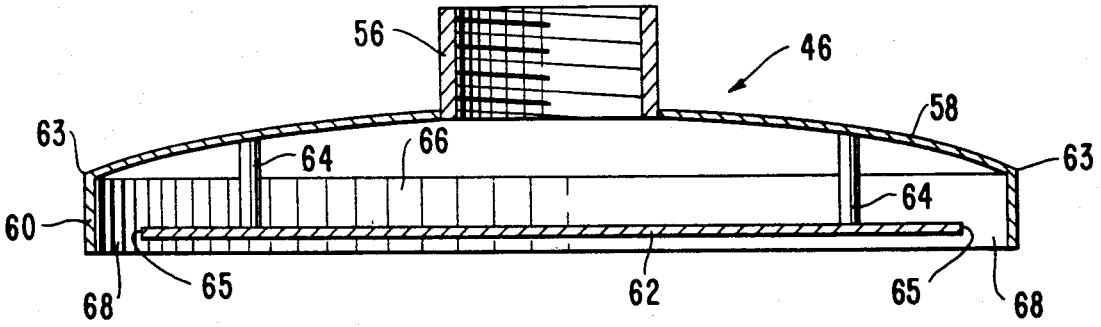
FIG. 14 is a cross section of the applicator head in FIG. 13 taken along line 14—14 thereof.

To provide the thin continuous film 59 of the microbath, the applicator head 46, as shown in FIGS. 13 and 14, comprises an upper horizontally extending retaining wall 58 having a circumferential rim 60 depending from the outer periphery 63 of the upper wall 58; and a lower horizontal wall 62 connected in spaced relation to the retaining wall 58. The periphery 65 of the lower wall 62 is spaced inwardly from the circumferential rim 60 to define a downwardly facing discharge opening 68 for the discharge of the dye composition. A dispersion plenum 66 is formed between the upper wall 58 and the lower wall 62 for dispersing the dye composition from a coupling 56, through the plenum 66, and to the discharge opening 68. To achieve the proper flow, the diameter of the lower wall 62 usually corresponds to the diameter of an inner frame 74 of the carrier 70 (FIG. 10).

The coupling 56 connects the applicator head 46 to the conduits 48. Pins 64 connect the lower wall 62 to the upper wall 58.

As shown in FIGS. 7 and 10, the applicator head 46 is positioned directly above the carrier 70, when the chamber 14 is in the dyeing work station 15C. Such a positioning permits the dye composition to flow out of the applicator head 46, through the discharge opening 68, and into a circumferential inlet 72 of the carrier 70. The circumferential inlet 72 of the carrier 70 is vertically aligned with the downwardly facing discharge opening 68 of the applicator head 46. The speed of the dye flow depends upon the dye composition, the textile material being dyed, the shape and size of the applicator head and the carrier, and the compound used as the non-reactive environment.

Figure 15:
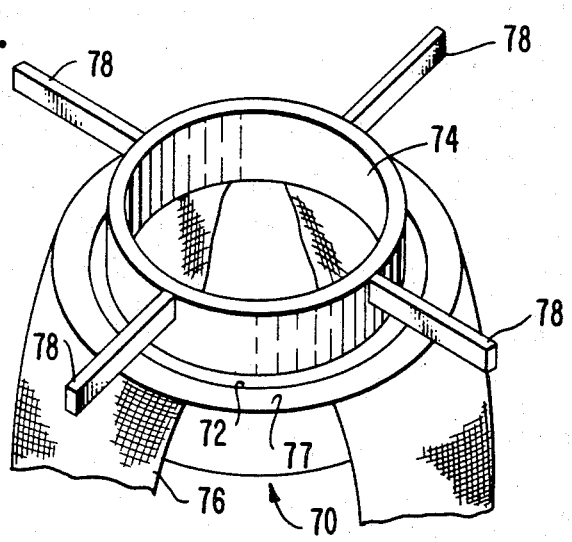
FIG. 15 is a top perspective view of a carrier and dye composition distribution head used in the present invention.
Figure 16:
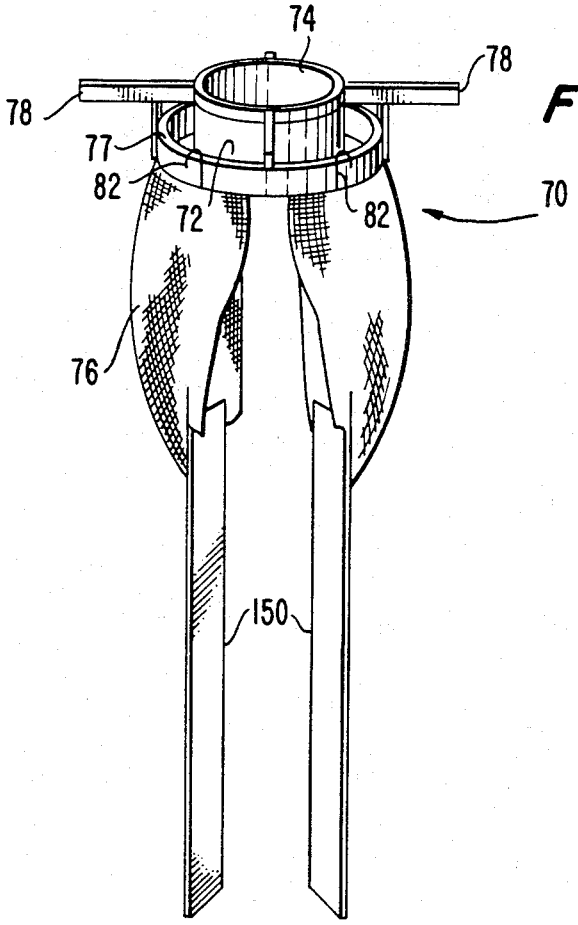
FIG. 16 is a front view of the carrier and dye composition distribution head shown in FIG. 15.

As shown in FIGS. 10, 15 and 16, the carrier 70, preferably, has an inner frame 74 having an outwardly extending bottom wall 73 and an outer frame and support 76 connected to the bottom wall 73 to form a trough configuration. The inner frame 74 and outer frame 76 together define the circumferential inlet 72 that lies horizontally above the bottom wall 73. The shaped article 12, such as a pair of pants, a skirt, or a shirt, is fitted onto the outer frame and support 76 of the carrier 70.

Preferably, the outer frame 76 is a perforated material, such as woven wire screen. This structure allows the dye composition to flow through as well as over the frame and thereby contact all sides of the shaped article 12 that is mounted thereon. The outer frame 76 is constructed to impart a smooth, dimensional shape to the desired areas of the shaped article 12. In the particular case where the shaped article 12 is a pair of pants, the carrier 70 also includes two flat blades 150 extending downwardly from the outer frame 76, (FIG. 16). The blades 150 are designed to impart creases to the leg portions of the pair of pants, and to maintain the surface of shaped article 12 in a smooth and unwrinkled condition during processing. The flat blades 150 may, if desired, be perforated to allow the dye composition to flow over and through or they may be two narrow bands with appropriate spacing and supports coinciding with the edges of the blades 150.

During the dyeing process, the dye composition flows from the applicator head 46 into the circumferential inlet 72 of the carrier 70. Some of the dye composition then flows over the top rim 77 of the outer frame 76 onto the outside portion of shaped article 12. Some of the dye composition also flows out through holes 79 (FIG. 10) in the sieve like material of the outer frame 76 to contact the underside of the shaped article 12 held on the outer frame 76. In this manner, both sides of the shaped article 12 on the outer frame 76 are contacted by the thin continuous film 59 of the dye composition, in accordance with the microbath technique.

The carrier 70 is held in proper position within the chamber 14, as the carousel unit 13 rotates, by attaching a top lip 75 of the carrier 70 within a ring 69 formed by a flange 71 on each wall 21 of each chamber 14, as shown in FIGS. 10 and 11. Each carrier 70 has bars 78, as shown in FIGS. 10 and 11, that coact with the ring 69 to hold the shaped article 12 on each carrier 70 in proper position for treatment by the work stations 15.

The outer frame 76 can also include a clip 82, along the rim 77 of the outer frame 76, to hold the shaped article 12 in place on the outer frame 76. The outer frame 76 can be constructed in a number of separate pieces to form the shaped article 12, placed on the carrier 70, into the desired shape. The size and shape of the outer frame 76 generally corresponds to the size and shape of the shaped article 12 that is to be positioned on the outer frame 76. For example, if the shaped article 12 is a pair of pants, the outer frame 76 can be constructed to provide to the pants the final desired shape.

After the dye composition has been applied to the shaped article 12, the dyed shaped article in the chamber 14 is rotated to the cooling work station 15D. As embodied herein, the cooling means includes gas blower means for circulating a gas around the shaped article 12 and a cooling unit 104 for cooling the gas circulating around the dyed shaped article. As embodied herein and shown in FIG. 2, the gas blower means includes a gas blower 102 and a blower conduit 103 leading the cool gas from the gas blower 102 into the chamber 14. The gas exits from the chamber 14 through cooling exhaust outlet 105.

The cooling unit 104 preferably contains one or more cooling coils as well as various temperature controls and dampers. The cooling coils can have a water source to cool the coils. Preferably, the cool gas blown on the dyed shaped article is one of the above identified compounds that provides a non-reactive environment. The cooling station 15D is constructed similar to the preheating station 15B shown in FIGS. 5, 6, and 11.

After the shaped article is cooled, the chamber 14 is rotated to the rinsing work station 15E shown in FIG. 12. Preferably, as shown in FIG. 12, two rinsing stations 15E-1 and 15E-2 having individual applicator heads 108 and 112, are used to apply a rinse liquid to the dyed shaped article. Fresh rinse liquid from a main tank 113 rinses shaped articles in rinse stations 15E-2 that have already been rinsed by the first rinse station 15E-1. The initial rinse of the freshly dyed and cooled, but unrinsed, shaped article 12 is carried out in rinse station 15E-1 that receives its rinse liquid from the downstream rinse station 15E-2. A pump 106 pumps the rinse liquid from a collection tank 114 through conduit 107 to the applicator head 108.

Consequently, recycled rinse liquid is used to rinse initially the shaped article 12 in rinse station 15E-1 while fresh rinse liquid is applied to the once rinsed shaped article 12 in rinse station 15E-2. This countercurrent rinse process permits the use of the cleaner or fresher rinse solvent on the shaped article 12 to remove completely the excess dye composition after it has already been rinsed once. The rinse solvent used in the first rinse station 15E-1, consequently, is very dirty and it is collected in a tank 115, prior to being pumped by a pump 110 through a conduit 111 to the distillation unit 118. Various valves 109 control the rinse liquid flow between the various components of the rinse stations.

Only one rinsing station, however, is necessary for the operation of the apparatus 10. As embodied herein, the rinsing means includes the applicator head 112 for flowing a thin continuous film of a rinse liquid over the surfaces of the dyed shaped article 12 and means for supplying the rinse liquid to the applicator 112. The rinsing means can further include a means for recycling the rinse liquid applied over the dyed shaped article 12. The rinse liquid is preferably one of the above identified compounds that provides a non-reactive environment, but used in the liquid phase.

As embodied herein, the recycling means includes a distillation unit 118 (FIG. 12) to separate the rinse liquid from the dye composition solvent and the collection tank 114 positioned beneath the chamber 14. The supply means includes a pump 122 for transporting the rinse liquid through one or more conduits 116 between the main tank 113 and the applicator head 112.

The applicator head 112, used to apply a continuous flow of the rinse liquid over the dyed shaped article 12 in the rinsing work stations 15E, is similar to the applicator head 46, used to apply the dye composition to the undyed shaped article in the dyeing work station 15C. The applicator head 112 is similarly positioned over the shaped article 12 on the carrier 70 so that a thin continuous film of the rinse liquid flows over all the surfaces of the shaped article 12 to form a microbath of the rinse liquid.

After the shaped article is rinsed, it is rotated to drying work station 15F as shown in FIGS. 1 and 2. As embodied herein, the drying means includes a gas blower means for circulating a gas around the dyed shaped article 12 and a heating unit 90 for heating the gas circulating around the dyed shaped article. As embodied herein, the gas blower means includes a gas blower 92, similar to the blower 30 of FIGS. 5 and 6 that is used to preheat the shaped article, and a blower conduit 94 leading the hot gas from the gas blower 92 into the chamber 14. The hot gas exits from the chamber 14 through the outlet 95.

The drying gas, preferably, is one of the above-described compounds that provide a non-reactive environment. Two separate drying stations 15F can be used in succession to dry effectively the shaped article. The drying station 15F is constructed similar to the preheating station 15B shown in FIGS. 5, 6, and 11.

The heating unit 90 preferably contains one or more heating coils, as well as various temperature controls and dampers. The heating coils can have a steam source to heat the coils.

After the shaped article 12 is dried, the chamber 14 is rotated to the unloading station 15A. The dyed and dried shaped article is removed from the chamber 14 through the port 16.

The dyeing of the shaped article is preferably conducted at atmospheric pressure, however, other pressures above and below atmospheric pressure can also be used, but effective sealing would then have to be provided.

The dye composition is a substantially non-aqueous system comprising a solvent, a dyestuff, and, if needed, one or more additives. Preferably, the solvent contains no water, but some water may be present. In the preferred embodiment, the solvent has a boiling point greater than water. The solvents used in the dye composition can be one of the aromatic esters and the cycloaliphatic diesters disclosed in U.S. Pat. No. 4,293,305 in the name of Robert B. Wilson.

More specifically, the aromatic ester can be of the formula $ArCOOR_2$, $ArCOO—R_1—OOCAr$ or (Ar- $COO)_z$—$R_3$, wherein $R_1$ is alkylene of 2–8 carbon atoms or polyoxyalkylene of the formula —$C_rH_{2r}$) ($OC_rH_{2r})_s$, in which r is 2 or 3 and s is up to 15; $R_2$ is substituted or unsubstituted alkyl or alkenyl of 8–30 carbon atoms; $R_3$ is the residue of a polyhydric alcohol having z hydroxyl groups; Ar is mono- or bicyclic aryl of up to 15 carbon atoms and z is 3–6.

Furthermore, the cycloaliphatic ester can be of the formula:

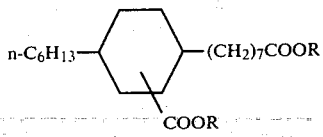

wherein R is substituted or unsubstituted straight or branched chain alkyl of 4–20 carbon atoms, polyoxyalkylene of the formula $R'(OC_xH_{2x})_n$ or phosphated polyoxyalkylene of the formula:

$$(HO)_2P(=O)(OC_xH_{2x})_nOC_xH_{2x})$$

or a salt thereof, wherein $(C_xH_{2x}O)_n$ is $(C_2H_4O)_n$—, $(C_3H_6O)_n$— or $(C_2H_4O)p$—, $(C_3H_6O)q$—; R′ is H or ArCO; Ar is mono- or bicyclic aryl of up to 15 carbon atoms; x is 2 or 3; n is 2–22 and the sum of p+q is n.

Other solvents include glycerides, such as vegetable oils of which corn oil, peanut oil, and blends thereof are examples, as well as fatty acids.

The dyestuffs can be those commonly found in the art, such as disperse, vat, reactive, direct, acid, basic, sulfur, and pigment. The additives can be any of those known in the art such as levelers, dye carriers, and organic finishing agents.

Prior to applying the dye composition to the shaped article in the dyeing work station 15C, the dye is heated to an elevated temperature. The heating of the dye composition is conducted in a non-reactive environment to minimize significantly the degradation of the dye composition. The temperature selected depends upon the shaped article being dyed, the particular dye composition, and the set contact time between the dye composition and the shaped article. The heated dye composition must flow over the shaped article for a time sufficient to cause the uniform dyeing of the shaped article to the desired color or shade. When the shaped article is a synthetic material, such as a polyester fabric, the dye composition is heated to a temperature above the glass transition temperature of the synthetic material but below the melting point of the synthetic material and the boiling point of the dye composition.

Additionally, by preheating the shaped article 12 in work station 15B to a temperature approximately equivalent to the temperature of the heated dye composition, a more rapid and better quality dyeing is achieved. Typically, when a synthetic material such as polyester is used, it is preheated to a temperature above the glass transition temperature of the synthetic material, but below its melting point and the boiling point of the dye composition. This temperature allows the shaped article 12 to form its shape on the carrier 70 during the dyeing process.

The shaped article 12 is cooled in the cooling work station 15D to a temperature below the temperature of the rinse liquid. With a synthetic material, the cooling temperature in the cooling work station 15D is below its glass transition temperature. This prevents the shaped article from changing its shape, a factor that is particularly important when a garment is being treated. Consequently, the shape of the shaped article 12 could be set to correspond substantially with the shape of the carrier 70.

The apparatus can be used in the dyeing of a variety of articles that are made of a textile material. The apparatus is especially usable to dye synthetic materials, such as polyester. Examples of other synthetic materials include polyamides, polyurethanes, acrylics, halogenated polyolefins, polyolefins such as polypropylene, aramids such as Kevlar and Nomex which are trademarks of E. I. DuPont de Nemours & Co., and epoxy plastics. The process can also be used to dye natural materials including cellulosic fibers such as cotton, wool, and silk. Likewise, blends of materials, such as a polyester-cotton or a polyester-wool can be dyed. Other synthetic and natural materials known in the art can be processed in the present apparatus.

The textile materials can be woven, nonwoven, knitted, tufted, or needle punched. Furthermore, an entirely cut and sewn shaped article ready for wear, such as a pair of pants, a skirt, or a shirt, can be dyed by the present apparatus.

The apparatus can also be used to dye a variety of articles that are made of non-textile materials that are capable of being dyed, such as plastic. Examples of such plastic shaped articles include toys, home furnishings, utensils, and automotive accessories.

Other embodiments of the invention will be apparent to one skilled in the art from a consideration of the specification or the practice of the invention disclosed herein. It is intended that the specification and examples be considered as exemplary only, with the true scope and spirit of the invention being indicated by the claims.

What is claimed is:

1. An apparatus for the dyeing of shaped articles comprising:

(a) a treatment chamber;

(b) means for surrounding a shaped article with a non-reactive environment in said treatment chamber; and (c) means for flowing a thin continuous film of a dye composition over the surfaces of said shaped article at an elevated temperature in the non-reactive environment.

2. The apparatus of claim 1, wherein the means for surrounding the shaped article comprises a gas vapor generator for producing the non-reactive environment.

3. The apparatus of claim 1, wherein the means for flowing a thin continuous film comprises:

(a) an applicator head for flowing a thin continuous film of the dye composition over the surfaces of the shaped article;

(b) means for supplying the dye composition to the applicator head; and (c) a heating unit for heating the dye composition prior to supplying the dye composition to the applicator head.

4. The apparatus of claim 3, wherein the applicator head is positioned directly above the shaped article.

5. The apparatus of claim 3, wherein the applicator head comprises:

(a) an upper horizontally extending retaining wall having a circumferential rim depending from the outer periphery of the upper wall; and (b) a lower horizontal wall connected in spaced relation to the upper wall, the periphery of the lower wall being spaced inwardly from the circumferential rim to define a downwardly facing discharge opening, the upper wall and the lower wall together forming a dispersion plenum.

6. The apparatus of claim 5, further comprising a carrier for positioning the shaped article in vertical alignment with the downwardly facing discharge opening of the applicator head.

7. The apparatus of claim 6, wherein the carrier comprises:

(a) an inner frame having an outwardly extending bottom wall;

(b) an outer frame connected to the bottom wall to form a trough configuration, the inner frame and the outer frame together defining a circumferential inlet lying horizontally above the bottom wall.

8. The apparatus of claim 7, wherein the circumferential inlet of the carrier is vertically aligned with the downwardly facing discharge opening of the applicator head.

9. The apparatus of claim 7, wherein the outer frame is perforated for passage of said dye composition therethrough onto said shaped article mounted thereon.

10. An apparatus for the dyeing of shaped articles comprising:, (a) a treatment chamber within the apparatus;

(b) means for transporting a shaped article in the treatment chamber (c) means for surrounding the shaped article with a non-reactive environment in the treatment chamber;

(d) means for flowing a thin continuous film of a dye composition over the surfaces of the shaped article at an elevated temperature in the non-reactive environment;

(e) means for preheating the shaped article prior to flowing the thin continuous film over the shaped article; and (f) means for cooling the dyed shaped article.

11. The apparatus of claim 10, wherein the transporting means includes:

(a) a carousel unit having a plurality of individual treatment chambers; and (b) a means for rotating the carousel unit.

12. The apparatus of claim 11, further comprising a plurality of walls separating the treatment chambers within the carousel unit.

13. The apparatus of claim 10, wherein the means for surrounding the shaped article comprises a gas vapor generator for producing the non-reactive environment.

14. The apparatus of claim 10, wherein the means for preheating the shaped article comprises:

(a) gas blower means for circulating a gas forming the non-reactive environment around the shaped article; and (b) a heating unit for heating the circulating gas.

15. The apparatus of claim 10, wherein the means for flowing a thin continuous film comprises:

(a) an applicator head for flowing a thin continuous film of the dye composition over the surfaces of the shaped article;

(b) means for supplying the dye composition to the applicator head; and (c) a heating unit for heating the dye composition prior to supplying the dye composition to the applicator head.

16. The apparatus of claim 15, wherein the applicator head is positioned directly above the shaped article.

17. The apparatus of claim 15, wherein the applicator head comprises:

(a) an upper horizontally extending retaining wall having a circumferential rim depending from the outer periphery of the upper wall; and (b) a lower horizontal wall connected in spaced relation to the upper wall, the periphery of the lower wall being spaced inwardly from the circumferential rim to define a downwardly facing discharge opening, the upper wall and the lower wall together forming a dispersion plenum.

18. The apparatus of claim 17, further comprising a carrier for positioning the shaped article in vertical alignment with the downwardly facing discharge opening of the applicator head.

19. The apparatus of claim 18, wherein the carrier comprises:

(a) an inner frame having an outwardly extending bottom wall;

(b) an outer frame connected to the bottom wall to form a trough configuration, the inner frame and the outer frame together defining a circumferential inlet lying horizontally above the bottom wall.

20. The apparatus of claim 19, wherein the circumferential inlet of the carrier is vertically aligned with the downwardly facing discharge opening of the applicator head.

21. The apparatus of claim 19, wherein the outer frame is perforated for passage of said dye composition therethrough onto said shaped article mounted thereon.

22. The apparatus of claim 10, wherein the means for cooling the dyed shaped article comprises:

(a) gas blower means for circulating a gas around the dyed shaped article; and (b) a cooling unit for cooling the gas circulating around the dyed article.

23. The apparatus of claim 10, further comprising means for rinsing the dyed article.

24. The apparatus of claim 23, wherein the rinsing means comprises:

(a) an applicator head for flowing a continuous thin film of the rinse liquid over the surfaces of the dyed article;

(b) means for supplying the rinse liquid to the applicator head; and

25. The apparatus of claim 24, further comprising means for recycling the rinse liquid applied over the dyed shaped article.

26. The apparatus of claim 24, wherein the rinse liquid and the non-reactive environment are the same compound.

27. The apparatus of claim 10, further comprising means for drying the dyed shaped article.

28. The apparatus of claim 27, wherein the drying means comprises:

(a) gas blower means for circulating a gas around the dyed shaped article; and (b) a heating unit for heating the gas circulating around the dyed shaped article.

* * * * *